United States Patent [19]

Errichiello

[11] 4,306,737

[45] Dec. 22, 1981

[54] LOOSELEAF NOTEBOOKS

[76] Inventor: Dominic R. Errichiello, 389 Meadowlark Rd., Bloomingdale, Ill. 60108

[21] Appl. No.: 63,862

[22] Filed: Aug. 6, 1979

[51] Int. Cl.[3] ..... B42D 3/18; B65D 33/06

[52] U.S. Cl. ..... 281/32; 281/18; 281/30; 281/31; 150/12; 206/472

[58] Field of Search ..... 281/1, 3, 4, 22, 26, 281/29, 30, 31, 36, 37, 32, 42; 402/80 P; 35/35 E, 35 H; 150/12, 28 R; 206/472–478; 190/51, 52

[56] References Cited

U.S. PATENT DOCUMENTS

| | | | |
|---|---|---|---|
| 1,136,598 | 4/1915 | Gould | 281/34 |
| 1,520,932 | 12/1924 | Comstock | 190/51 X |
| 1,524,647 | 2/1925 | Albrecht | 281/31 |
| 2,088,953 | 8/1937 | Greer | 281/31 |
| 2,477,806 | 8/1949 | Isaacson | 224/225 |
| 2,801,002 | 7/1957 | Volckening | 206/472 X |
| 2,937,728 | 5/1960 | Koffler | 190/51 |
| 3,009,485 | 11/1961 | Beyer | 281/29 |
| 3,019,486 | 2/1962 | Stinson | 281/37.5 |
| 3,088,753 | 5/1963 | Sendor | 281/29 |
| 3,126,891 | 3/1964 | Caputi | 402/31 X |
| 3,306,405 | 2/1967 | Rosenblum | 190/51 |
| 3,912,140 | 10/1975 | Franges | 150/12 X |
| 3,981,522 | 9/1976 | Bloom | 281/34 |
| 4,000,951 | 1/1977 | Agnew et al. | 402/75 X |
| 4,063,369 | 12/1977 | Hart | 281/31 X |

FOREIGN PATENT DOCUMENTS

| | | | |
|---|---|---|---|
| 2303218 | 7/1974 | Fed. Rep. of Germany | 402/74 |
| 2359041 | 5/1975 | Fed. Rep. of Germany | 206/443 |
| 840343 | 7/1960 | United Kingdom | 190/52 |
| 1436453 | 5/1976 | United Kingdom | 402/80 P |

*Primary Examiner*—Paul A. Bell
*Assistant Examiner*—John S. Brown
*Attorney, Agent, or Firm*—Keil & Witherspoon

[57] ABSTRACT

Looseleaf notebooks having an integrally molded spine and front and rear cover panels with living hinge connections to the spine, the inside faces of said covers having a shallow, rectangular cavity for holding instructions, labels, decals, cards, etc., one or more snap-on pockets for holding a variety of articles, and pairs of snap-in ribs to hold pencils, rulers, etc.; the spine-remote edges of said panels optionally having integrally molded handles for carrying the notebooks, and page marker strips hingedly mounted on the rear cover panel.

9 Claims, 7 Drawing Figures

LOOSELEAF NOTEBOOKS

BACKGROUND AND BRIEF DESCRIPTION OF THE INVENTION

The subject looseleaf notebooks embody refinements and new innovations for the looseleaf books described and claimed in my copending application Ser. No. 063,863, filed of even date herewith. The features of the looseleaf books therein described can also be employed in the subject looseleaf notebooks. Accordingly, the disclosure of said copending application is incorporated herein by reference as if it had been set forth in its entirety.

The subject looseleaf notebooks are designed principally as notebooks for students of all ages, from grammar or elementary school through college or university. The covers and/or spine may be plain or textured and may or may not have indicia-bearing molded inserts in shallow cavities molded into the front face of the front cover panel and/or the rear face of the spine.

The additional features herein disclosed for the looseleaf notebooks with an integrally molded spine and front and rear cover panels with living hinge connections to the spine include a shallow, rectangular cavity in the inner face of one or both panels, for holding instructions, labels, decals, cards, etc.; one or more snap-on pockets for holding a variety of articles, and pairs of snap-in ribs to hold pencils, rulers, etc.; handles for carrying the notebook integrally molded on the spine remote edge of said cover panels; and integrally molded, page marker strips hingedly mounted on the rear cover panel.

PRIOR ART

The prior art listed in my copending application is for the most part apropos herein. However, no prior art is known which discloses the aforesaid additional features.

PREFERRED EMBODIMENTS

Preferred embodiments of the invention are illustrated in the drawings, wherein:

Figure 1:
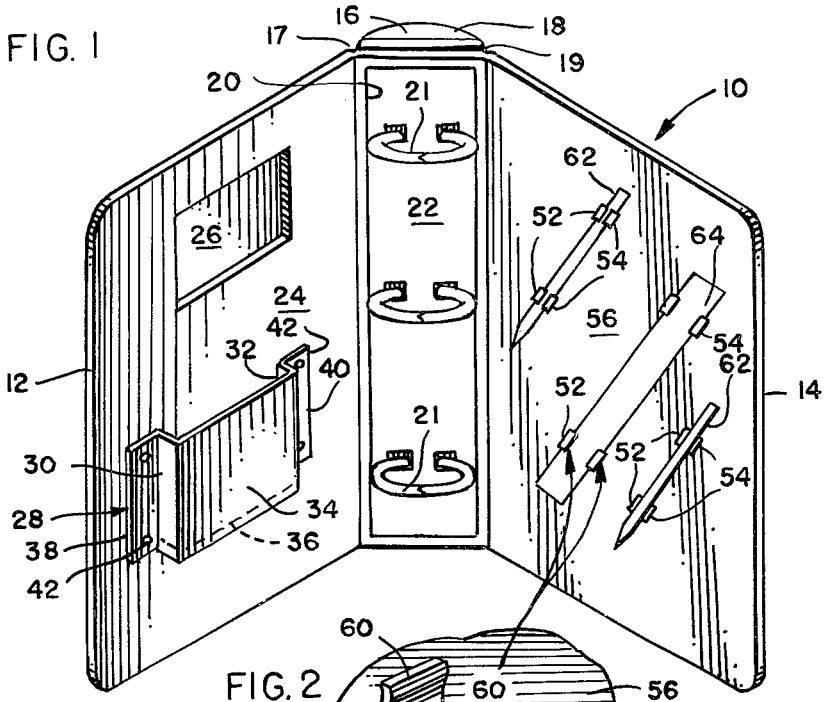
FIG. 1 is a perspective view of the inside parts of a notebook, with the cover panels in partially open position.
Figure 2:
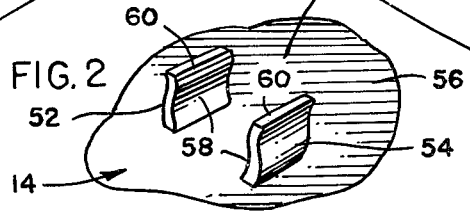
FIG. 2 is an enlarged, fragmentary, detail view of one of the snap-in ribs used in the notebook of FIG. 1.

Referring to the drawings, the notebook 10 comprises an integrally molded combination of a front cover panel 12, a rear cover panel 14, and a spine 16. The panels 12 and 14 are hingedly connected to respective longitudinal edges of the spine 16 by living hinges 17 and 19, which are molecularly oriented, integrally molded, narrow necks which flex and function as hinges. As more fully described in my copending application, the rear, outer face of the spine 16 has a shallow cavity (not shown) in which the transversely rounded, spine insert 18 is mounted. The front, inner face of the spine also has a shallow cavity 20 in which the snap-ring assembly 22, having three snap rings 21, is mounted. Suitable and preferred, old and new styles of snap-ring assemblies are set forth in more detail in my copending application.

Figure 4:
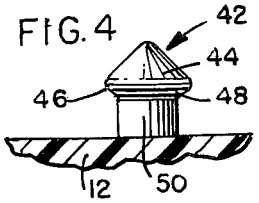
FIG. 4 is a fragmentary side elevation of a molded button used to fasten the snap-on pocket to the inside face of a cover panel.

The inner face 24 of the front cover panel 12 has a shallow, rectangular cavity or recess 26 in which may be placed by the student or the retail store or the manufacturer of the notebook items such as I.D. cards, instructions, labels, decals, cards, etc. The inner face 24 also has a removable, snap-on pocket 28 made of plastic or other suitable material and comprising opposite, vertical side walls 30 and 32, a front wall 34 parallel with the face 24 and spaced therefrom, a bottom wall 36, and flanges or flaps 38, 40 extending outwardly from the respective inner longitudinal edges of the side walls 30, 32. Each flange or flap has two holes, grommets or female snap components which mate with the four buttons 42 which are integrally molded on the inner face 24. The preferred buttons 42 (FIG. 4) used with holes or grommets comprise a substantially conical head 44 having a rounded base 46. A tapered section 48 below the base 46 connects the base with the neck 50.

The inner face 56 of the rear cover panel 14 has integrally molded thereon several pairs of opposed ribs 52, 54 having lower, transversely concave, opposed faces merging with outer, transversely convex, opposed lips 60. The ribs can flex to a limited degree, and the ribs of each pair are spaced to receive and releasably grip pencils and/or pens 62 and a ruler 64, two sets of rib pairs being used for each item.

Figure 3:
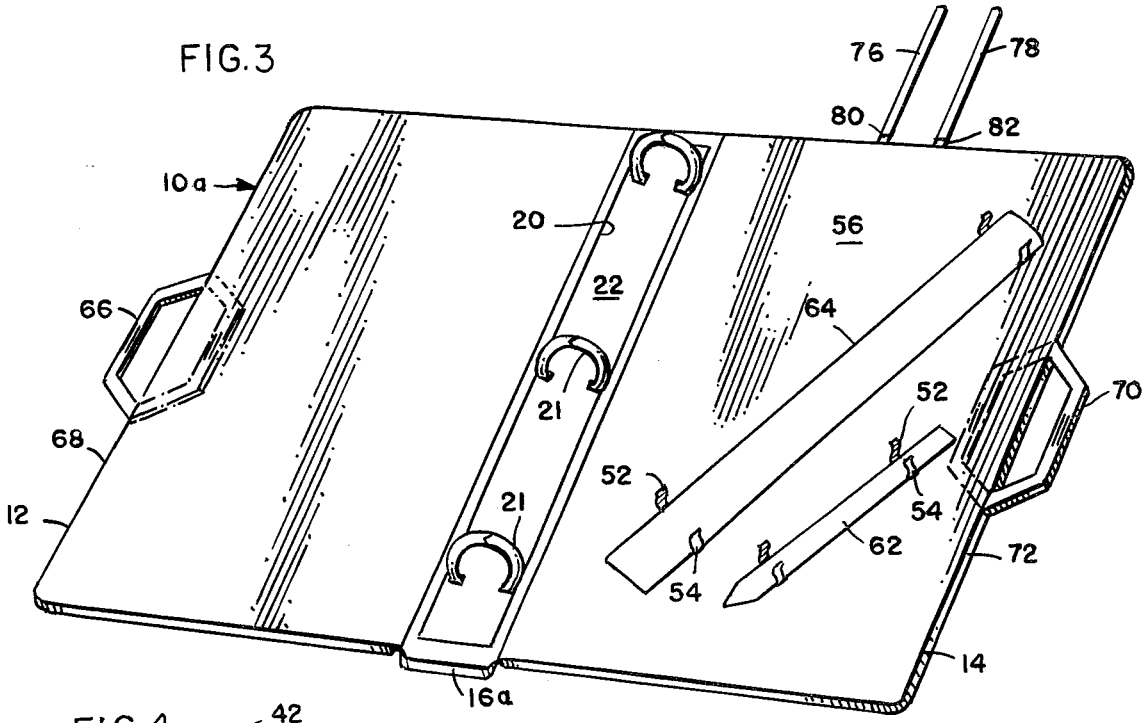
FIG. 3 is a perspective view of the inside parts of another notebook, with the cover panels laid flat.

The embodiment of FIG. 3 is similar to the embodiment of FIG. 1. Where applicable, like reference numerals designate like parts. The spine **16*a* in FIG. 3 is a flat spine without a spine insert 18, an optional feature in the subject invention. The chief differences between the notebooks of FIGS. 1 and 3 are the two plastic handles 66, 70 molded integrally on the outer, longitudinal edges 68, 72 of the cover panels 12, 14 and the two page marker, integrally molded strips 76, 78 on the top edge of the rear cover panel 14. The strips 76, 78 preferably are connected to the panel 14 by living hinges 80, 82. They can be laid flat against the inner face 56 of the rear cover panel when not in use. When used, each strip can be laid across a looseleaf page mounted on the snap-rings 21** to serve as a marker for the particular page.

When the notebook **10*a* of FIG. 3 is closed, the two handles 66, 70 meet and together serve as the handle by which the notebook 10*a* is carried by hand with its spine 16*a*** facing downwardly.

Figure 5:
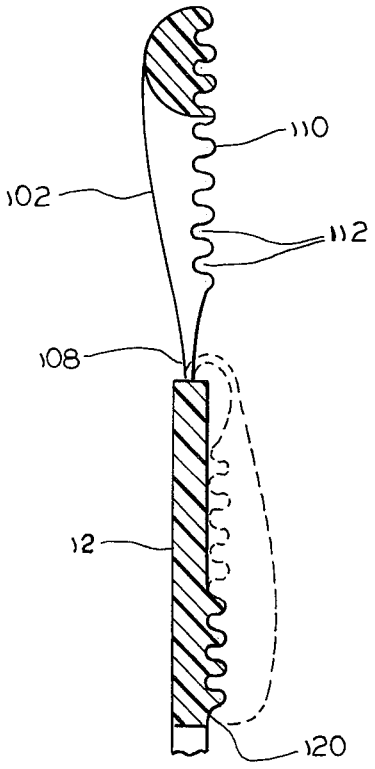
FIGS. 5–7 are views of a modified form of handle.
Figure 6:
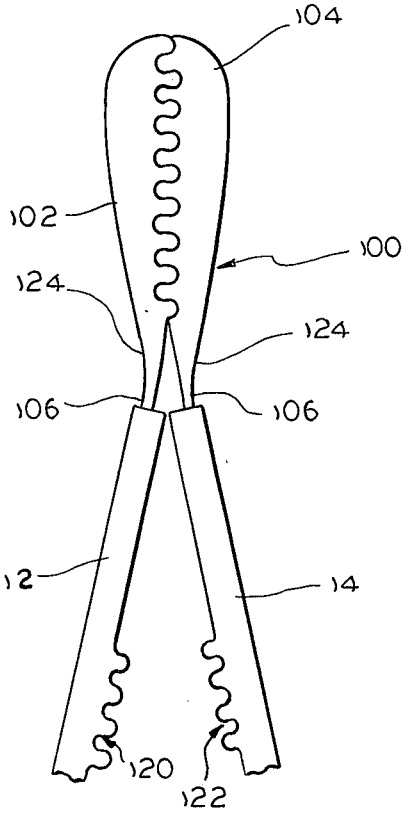
Figure 7:
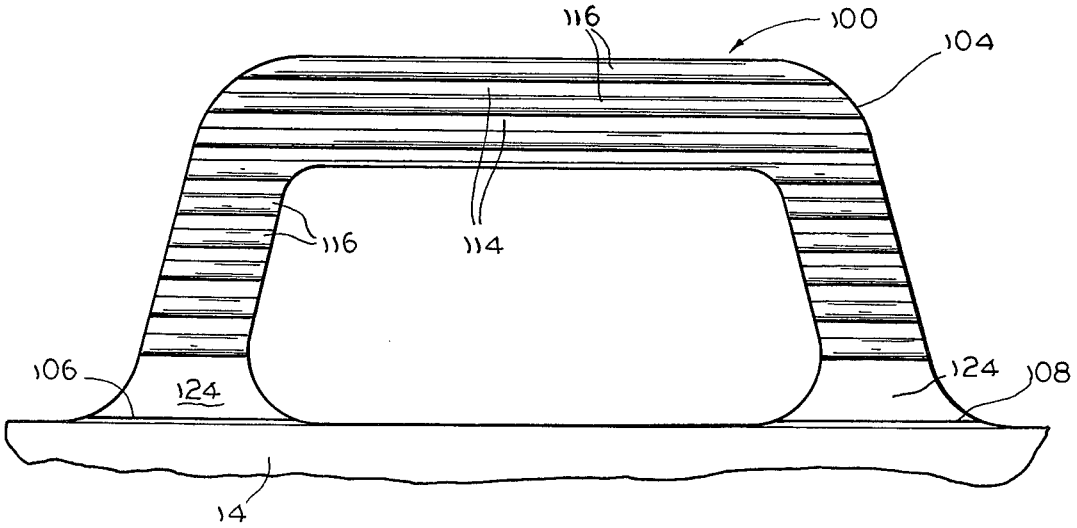

The handle 100 of FIGS. 5–7 comprises a U-shaped first side 102 and a mating, U-shaped second side 104, which together form the overall handle 100. The first side 102 is molded integrally with the spine-remote side of the panel 12 while the second side 104 is molded integrally with the spine-remote side of the panel 14. They are joined by living hinges 106 and 108 which allow each half side 102 and 104 to swing 180° into parallel relationship with the panel 12 or 14 (as shown in phatom in FIG. 5).

The opposed faces of the half sides 102 and 104 have horizontal, alternating ribs 110 and 116 and grooves 112 and 114. The ribs are slightly rounded beads whose heads define slightly narrower necks at the entrant sides of the grooves. When pressed together, the ribs 110 interlock in grooves 114 and the ribs 116 interlock in grooves 112 to hold the two sides of the handle together and to keep the book or portfolio closed. When not in use, the half sides 102 and 104 are swung 180° about the living hinges 106, 108 into parallel relationship with the panels 12, 14 and can be locked in this position by mating, tongue and groove inserts in the panels 12, 14.

It will be noted from FIG. 6 that the edges of panels 12, 14 abut when the handle sides are locked together. This would be typical of looseleaf notebooks of the type described in my copending application Ser. No. 063,863, and those herein. The disclosure of said application is incorporated by reference as if it had been set forth in its entirety.

It will be appreciated from the foregoing that the invention herein can take many forms other than the preferred forms shown in the drawings and that the invention as herein claimed is not limited to the illustrated embodiments.

I claim:

1. A book having a spine and front and rear cover panels made of molded plastic, means hingedly mounting said cover panels on said spine, and a corresponding edge of each panel having integrally molded thereon a handle, which handles are substantially aligned when the book is closed, means on respective handles for releasably interlocking said handles when they are brought close to each other and are substantially aligned, said handles being joined with their respective cover panels by flexible means allowing said handles to be pivoted and laid substantially flat against the inner face of their respective panel, and interlocking means on the respective inner faces of said panels positioned to releasably interlock with mating means on the respective handles when the respective handles are laid substantially flat against the respective inner faces of the respective front and rear cover panels, whereby said handles either can project outwardly beyond their respective panel or can be laid flat against the inner face of their respective panel.

2. A book as claimed in claim 1, wherein said cover panels are rectangular panels having one straight edge hingedly connected with said spine and having an opposite, outer straight edge, and said handles being hingedly mounted on the respective outer straight edge of the respective panel, whereby said book can be carried by said handles with the spine facing downwardly.

3. A book having interlocking handle parts comprising a first cover panel and a second cover panel respectively hingedly connected to opposite longitudinal sides of a spine, a first half of a U-shaped handle on an edge of said first panel and a second half of said U-shaped handle on a corresponding edge of said second panel, said halves being mounted on their respective panel edge by hinge means between the panel edge and ,he ends of the U-arms of each U-shaped handle half to allow said halves to pivot 180° between an extended position with the handle half lying in the plane of each panel and a retracted position in which each half lies substantially flat against the inner face of its panel, and means on each inner face for releasably holding its half of said handle in the retracted position.

4. A book as claimed in claim 3, wherein, when said book is closed and said halves of said handle are in the extended position, said halves are in face-to-face relationship, are releasable, interlocking means on said halves for holding said halves together to form said handle and also to keep said book closed.

5. The apparatus as claimed in claims 1 or 3 further comprising:

a plurality of pairs of outwardly projecting spaced, opposed, springable, plastic ribs with opposed faces integrally molded on the inner face of at least one of said cover panels for releasably holding between respective pairs of ribs one or more items such as pencils, pens, rulers, and the like.

6. A book as claimed in claim 5 wherein the lower portions of said opposed faces of said ribs nearest said inner face are transversely concave.

7. The apparatus as claimed in claims 1 or 3 further comprising:

pocket forming means having a front wall, side walls and a bottom wall, and means on said side walls for releasably mounting said pocket-forming means on the inner face of one of said cover panels to provide thereon a pocket adapted to hold items placed therein by the user of the book.

8. The apparatus as claimed in claims 1 or 3 further comprising:

one or more narrow flexible strips integrally molded on an edge of either said front cover panel or said rear cover panel by living hinges, which allow said strips to be pivoted and laid flat against the inner face of said cover panel when said strips are not being used as page markers.

9. A book comprising a front cover panel and a rear cover panel respectively hingedly connected to opposite longitudinal sides of a spine, a U-shaped handle member having the ends of its U-arms hingedly mounted on an edge of a cover panel to allow said handle member to pivot 180° between an extended position with the handle member lying in the plane of the panel and a retracted position in which the handle member lies substantially flat against the inner face of the panel, and means on said inner face for releasably holding said handle member in the retracted position.

* * * * *

UNITED STATES PATENT AND TRADEMARK OFFICE

CERTIFICATE OF CORRECTION

PATENT NO. : 4,306,737

DATED : December 22, 1981

INVENTOR(S) : Dominic R. Errichiello

It is certified that error appears in the above—identified patent and that said Letters Patent is hereby corrected as shown below:

Claim 4, (col. 4, line 10) "are releasable," should read -- and releasable --.

Signed and Sealed this

*Eighteenth* Day of *May 1982*

[SEAL]

*Attest:*

GERALD J. MOSSINGHOFF

*Attesting Officer*

*Commissioner of Patents and Trademarks*